US010167766B2

(12) United States Patent
Birschbach et al.

(10) Patent No.: US 10,167,766 B2
(45) **Date of Patent: *Jan. 1, 2019**

(54) REVERSE FIN COOLING FAN

(71) Applicant: Briggs & Stratton Corporation, Wauwatosa, WI (US)

(72) Inventors: Brett Birschbach, Wauwatosa, WI (US); Rodney John Balzar, West Bend, WI (US); Jeffery P. Feist, Pewaukee, WI (US); Casey E. Groh, Shorewood, WI (US); Brian Johnson, Kewaskum, WI (US); Randall J. Klotka, Grafton, WI (US); Darwin A. Podhola, Mukwonago, WI (US); Ryan Sullivan, West Bend, WI (US); Matt Martinek, Cedarburg, WI (US); Brian Paul, Wauwatosa, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 149 days.

This patent is subject to a terminal disclaimer.

(21) Appl. No.: 15/153,564

(22) Filed: May 12, 2016

(65) Prior Publication Data

US 2016/0312796 A1 Oct. 27, 2016

Related U.S. Application Data

(63) Continuation-in-part of application No. 14/695,999, filed on Apr. 24, 2015.

(51) Int. Cl.
*F01P 1/02* (2006.01)
*F04D 29/28* (2006.01)
(Continued)

(52) U.S. Cl.
CPC ..... *F01P 1/02* (2013.01); *F01P 11/12* (2013.01); *F04D 17/025* (2013.01); *F04D 17/16* (2013.01);
(Continued)

(58) Field of Classification Search
CPC ..... F04D 29/58; F04D 29/66; F04D 29/28; F04D 29/584; F04D 29/281;
(Continued)

(56) References Cited

U.S. PATENT DOCUMENTS 4,358,245 A 11/1982 Gray
6,372,005 B1 4/2002 Fiacco
(Continued)

*Primary Examiner* — Jacob Amick
(74) *Attorney, Agent, or Firm* — Foley & Lardner LLP

(57) ABSTRACT

An engine assembly includes a crankcase, shaft, blower housing, and cooling fan. The shaft is rotatably coupled to the crankcase and defines a rotational axis. The blower housing includes an internal space. The cooling fan is disposed within the internal space, includes a plate defining an upper surface, and is positioned to rotate with the shaft about the rotational axis. The cooling fan includes a band having an inner band radius and an outer band radius. The cooling fan includes a plurality of reversed fins extending between the band and the upper surface and between a root adjacent to the rotational axis and a tip adjacent to the outer band radius, each fin offset at an angle measured in a counterclockwise direction from a plane passing through the rotational axis and the tip to a plane passing through the root and the tip when viewed from above the cooling fan.

19 Claims, 16 Drawing Sheets

(51) Int. Cl.

| | |
|---|---|
| ***F04D 17/02*** | (2006.01) |
| ***F04D 17/16*** | (2006.01) |
| ***F04D 29/30*** | (2006.01) |
| ***F01P 11/12*** | (2006.01) |

(52) U.S. Cl.
CPC ..... *F04D 29/281* (2013.01); *F04D 29/30* (2013.01); *F05D 2250/70* (2013.01)

(58) Field of Classification Search
CPC ..... F04D 29/666; F04D 17/025; F04D 17/16; F04D 29/30; F01P 1/02; F01P 11/12
See application file for complete search history.

(56) References Cited

U.S. PATENT DOCUMENTS

| | | | | |
|---|---|---|---|---|
| 6,514,304 | B2 | 2/2003 | Fiacco | |
| 6,726,734 | B2 | 4/2004 | Bayer et al. | |
| 7,225,765 | B2 | 6/2007 | Leech et al. | |
| 7,794,204 | B2 | 9/2010 | Stevens et al. | |
| 8,091,177 | B2 | 1/2012 | Cote et al. | |
| 8,746,186 | B2 | 6/2014 | Sullivan et al. | |
| 9,926,832 | B2 * | 3/2018 | Birschbach | F01P 5/04 |
| 2009/0293835 | A1 * | 12/2009 | Nakamizo | F01P 11/12 123/198 E |
| 2012/0027597 | A1 * | 2/2012 | Kang | F04D 29/282 416/183 |
| 2014/0053793 | A1 | 2/2014 | Sullivan et al. | |
| 2014/0053794 | A1 | 2/2014 | Matel | |
| 2015/0192143 | A1 | 7/2015 | Sakai et al. | |
| 2016/0312684 | A1 * | 10/2016 | Birschbach | F01P 5/04 |

* cited by examiner

REVERSE FIN COOLING FAN

CROSS-REFERENCE TO RELATED APPLICATIONS

This application is a continuation-in-part of U.S. patent application Ser. No. 14/695,999, filed Apr. 24, 2015, the entire contents of which are incorporated herein by reference.

BACKGROUND

The present invention relates generally to the field of small air-cooled internal combustion engines, and particularly to the field of cooling fans for small air-cooled internal combustion engines.

SUMMARY

One embodiment relates to an engine assembly. The engine assembly includes a crankcase, a shaft, a blower housing, and a cooling fan. The shaft is rotatably coupled to the crankcase and defines a rotational axis. The blower housing includes an internal space. The cooling fan is disposed within the internal space, includes a plate defining an upper surface, and is positioned to rotate with the shaft about the rotational axis. The cooling fan includes a band having an inner band radius and an outer band radius. The cooling fan includes a plurality of reversed fins extending between the band and the upper surface and between a root adjacent to the rotational axis and a tip adjacent to the outer band radius, each fin offset at an angle measured in a counterclockwise direction from a plane passing through the rotational axis and the tip to a plane passing through the root and the tip when viewed from above the cooling fan.

Another embodiment relates to a fan assembly that includes a cooling fan and a screen. The cooling fan defines a central axis and includes a plate, a band, and a plurality of reversed fins. The plate defines an upper surface and a lower surface. The band has an inner band radius and an outer band radius. The plurality of reversed fins extend between the band and the upper surface of the plate, and extend between a root adjacent to the central axis and a tip adjacent to the outer band radius. Each fin is offset at an angle measured in a counterclockwise direction from a plane passing through the rotational axis and the tip to a plane passing through the root and the tip when viewed from above the cooling fan. The screen is coupled to the cooling fan and is disposed along the plurality of reversed fins. The screen includes a hub positioned orthogonal to the central axis. The screen includes a plurality of blades extending radially outward from the hub. A leading edge of each blade is the thinnest cross-sectional portion of each of the plurality of blades.

Another embodiment relates to a cooling fan. The cooling fan includes a plate, a band, and a plurality of reversed fins. The plate has an upper surface and a lower surface and defines a central axis. The band includes an inner band radius and an outer band radius. The plurality of reversed fins extend between the band and the upper surface of the plate, and extend between a root adjacent to the central axis and a tip adjacent to the outer band radius. Each fin is offset at an angle measured in a counterclockwise direction from a plane passing through the rotational axis and the tip to a plane passing through the root and the tip when viewed from above the cooling fan.

Alternative exemplary embodiments relate to other features and combinations of features as may be generally recited in the claims.

BRIEF DESCRIPTION OF THE DRAWINGS

The invention will become more fully understood from the following detailed description, taken in conjunction with the accompanying figures, in which like reference numerals refer to like elements.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

According to one embodiment, a cooling fan as described herein is a fan used to move air and thereby cool an engine. The cooling fan may be provided as part of an engine assembly or as part of a fan assembly, among other alternatives. The cooling fan provides a flow of air that passes along a surface of the engine that has a high temperature and cools the surface by convection processes. A clockwise rotation of the cooling fan (e.g., when viewed from above with the cooling fan and engine installed in a normal operating position, etc.), causes relatively cool air to be drawn from outside the engine, down through the fan, and to pass over the relatively hot surfaces of the engine. The engine may be an internal combustion engine and may generate power by combusting a fuel in the presence of an oxidant. The fuel may include, but is not limited to, a gasoline-type fuel, a diesel-type fuel, a jet-type fuel, a blended fuel including gasoline-, diesel-, and jet-type fuels as well as a blending agent such as ethanol, or any other fuel. The oxidant may be air, pure oxygen, a combination thereof, or any other oxidant.

In some embodiments, the engine includes at least one cylinder and at least one piston that facilitate combustion, from which power is generated. The piston may facilitate combustion by following a cycle, such as a four-stroke cycle including an intake stroke, a compression stroke, an expansion or power stroke, and an exhaust stroke, or any other combustion cycle. As combustion occurs in the engine, the fuel and oxidant are converted into products and heat is released. Part of the released heat is transferred to the cylinder and other components of the engine. The piston may direct the power generated by the combustion cycle to provide output power. The engine may be provided alone, as part of a mower, as part of a pressure washer, or as part of still another piece of power equipment. The cooling fan as described herein provides a flow of air to cool the engine that has increased in temperature due to combustion, without excessive noise. In some embodiments, the cooling fan reduces air turbulence (e.g., around the tip of a fin, as the fins rotate and drive the surrounding air, etc.), thereby reducing noise traditionally generated by turbulence. In some embodiments, the spacing between the tip of a fin and a surrounding housing is increased (e.g., relative to traditional cooling fan systems, etc.) or otherwise specified to decrease blade pass frequency and thereby reduce blade pass noise.

Figure 1:
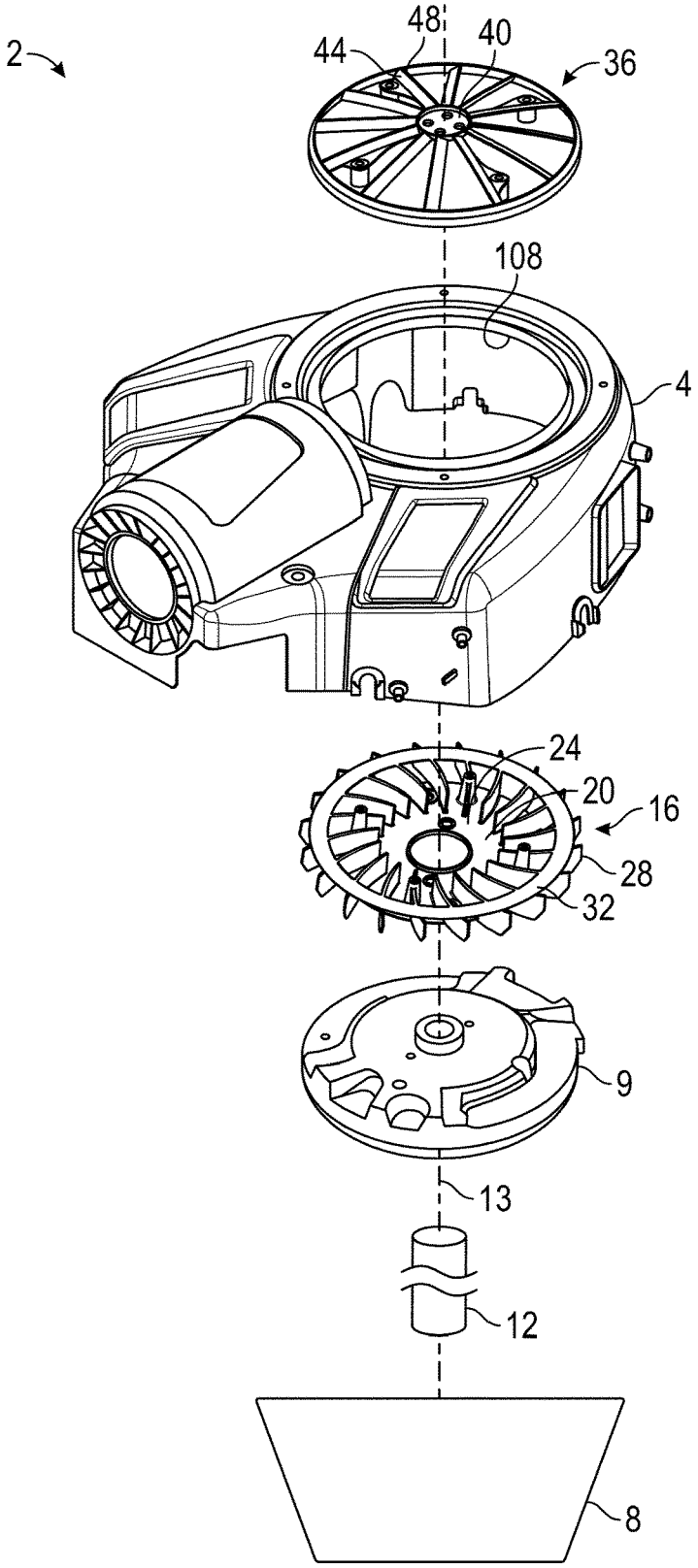
FIG. 1 is an exploded perspective view of an engine assembly having a cooling fan.

Referring to FIG. 1, an engine assembly 2 includes a housing 4 (e.g., a blower housing), a crankcase 8, a flywheel 9, a shaft 12, a cooling fan 16, and a screen 36. The shaft 12 is coupled (e.g., rotatably coupled) to the crankcase 8 and defines a rotational axis 13. The housing 4 has a sidewall 108 that defines an internal space (e.g., the housing includes the internal space). When the engine assembly 2 is assembled, the cooling fan 16 is disposed at least partially within the internal space of the housing 4 and is coupled to the shaft 12. By way of example, the flywheel 9 may be coupled to the shaft 12, and the cooling fan 16 may be coupled to the flywheel 9. The cooling fan 16 includes a plate 20, a band 32, and a plurality of reversed fins 28. When the engine assembly 2 is assembled, the screen 36 is coupled to the cooling fan 16 and disposed above the plurality of fins 28. The screen 36 includes a hub 40 positioned orthogonal to the rotational axis 13 and a plurality of blades 44 extending radially outward from the hub 40.

Figure 2:
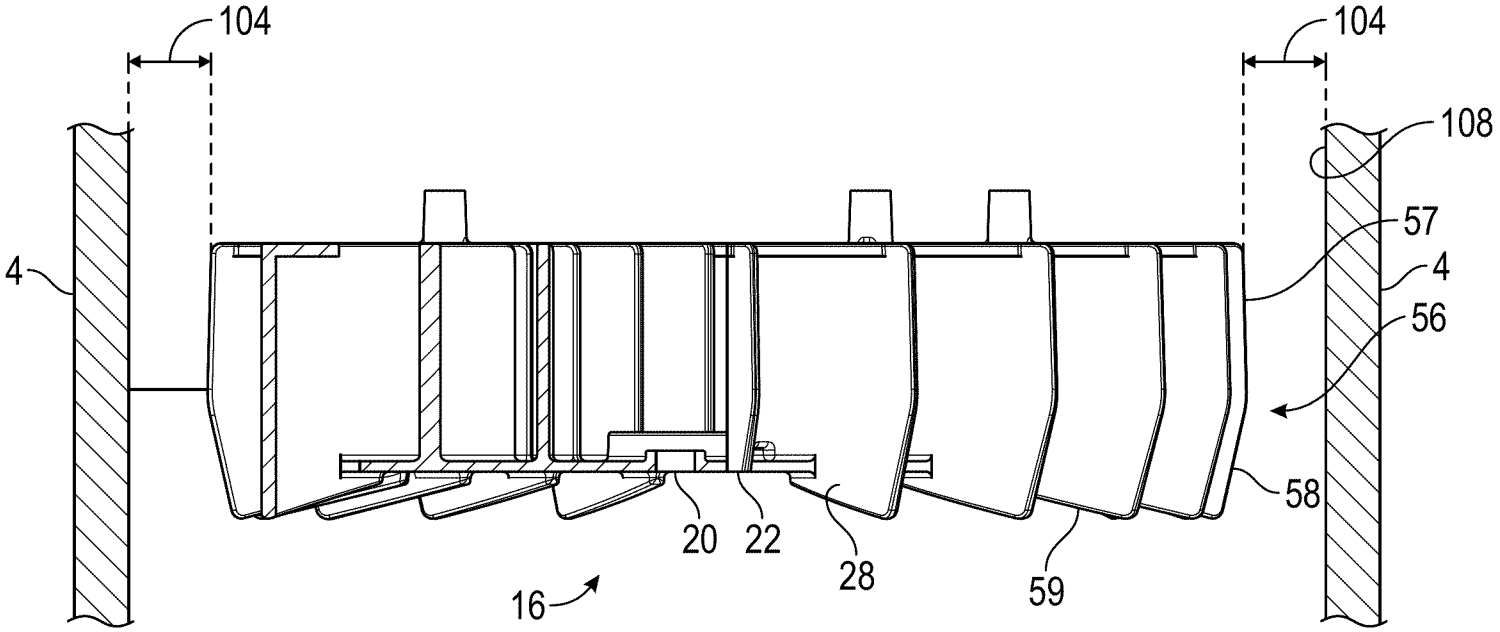
FIG. 2 is a sectional view of a housing and a cooling fan of the engine assembly of FIG. 1.

Referring to FIG. 2, the housing 4 and the cooling fan 16 cooperate to cool the engine assembly 2 and subcomponents of the engine assembly 2. In one embodiment, the distance 104 between the housing 4 and the tips 56 of the plurality of fins 28 is not more than 2 inches. The distance 104 may be defined as the shortest distance from the tip 56 to the sidewall 108 of the housing 4. This spacing aids in directing air flow in a manner so as to reduce turbulence and blade pass frequency and thereby reduce noise. In some embodiments, the distance 104 is less than one inch. In one embodiment, the distance 104 is about 0.75 inches.

In some embodiments, the cooling fan 16 and the screen 36 of the engine assembly are coupled to co-rotate (e.g., by being integrally formed and defining a single unitary body, etc.). In some embodiments, the band 32 is continuous between the cooling fan 16 and the screen 36. In some embodiments, another portion of the cooling fan 16 is continuous with the screen 36 such that the cooling fan 16 and the screen 36 are integrally formed and define a single unitary body. In some embodiments, the shaft 12 is coupled with each of the cooling fan 16 and the screen 26, causing them to co-rotate. The shaft 12 may be connected to a crankshaft 11 of the engine assembly 2 (e.g., with gears, directly, etc.), such that the shaft 12 rotates in the rotational axis 13 based on output from the crankshaft 11.

Figure 3:
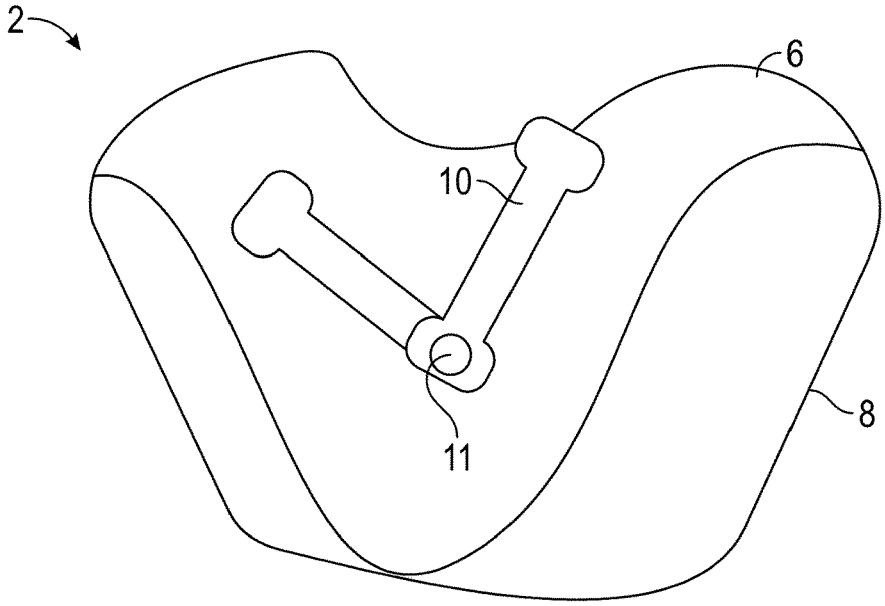
FIG. 3 is a cutaway schematic diagram of an engine having two cylinders in a V-twin configuration.
Figure 4A:
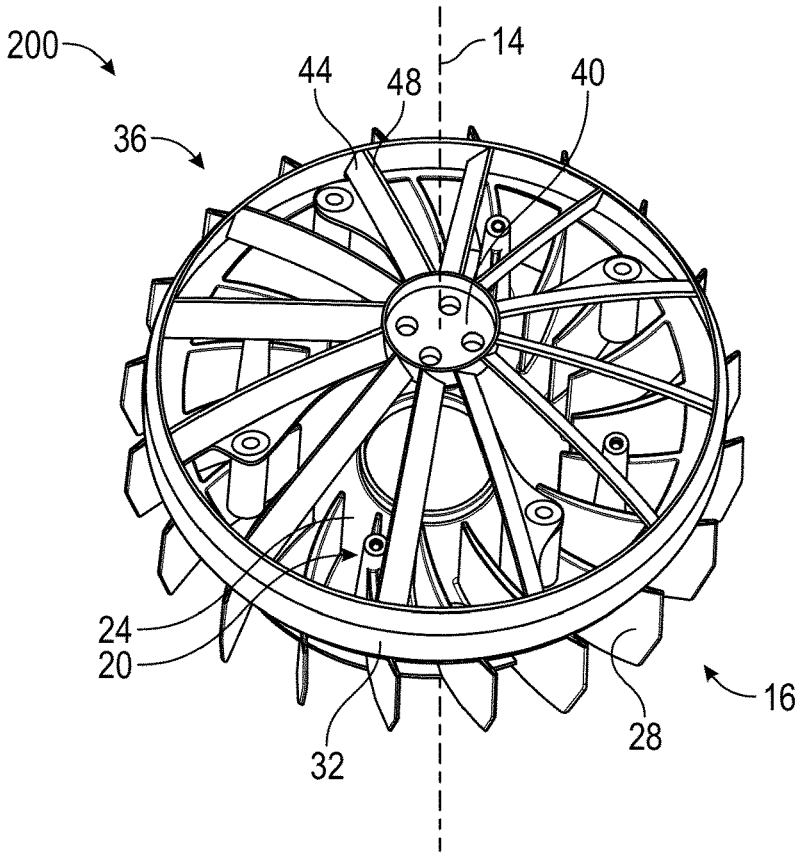
FIG. 4A is a perspective view of a fan assembly for an engine that includes a cooling fan and a screen.
Figure 4B:
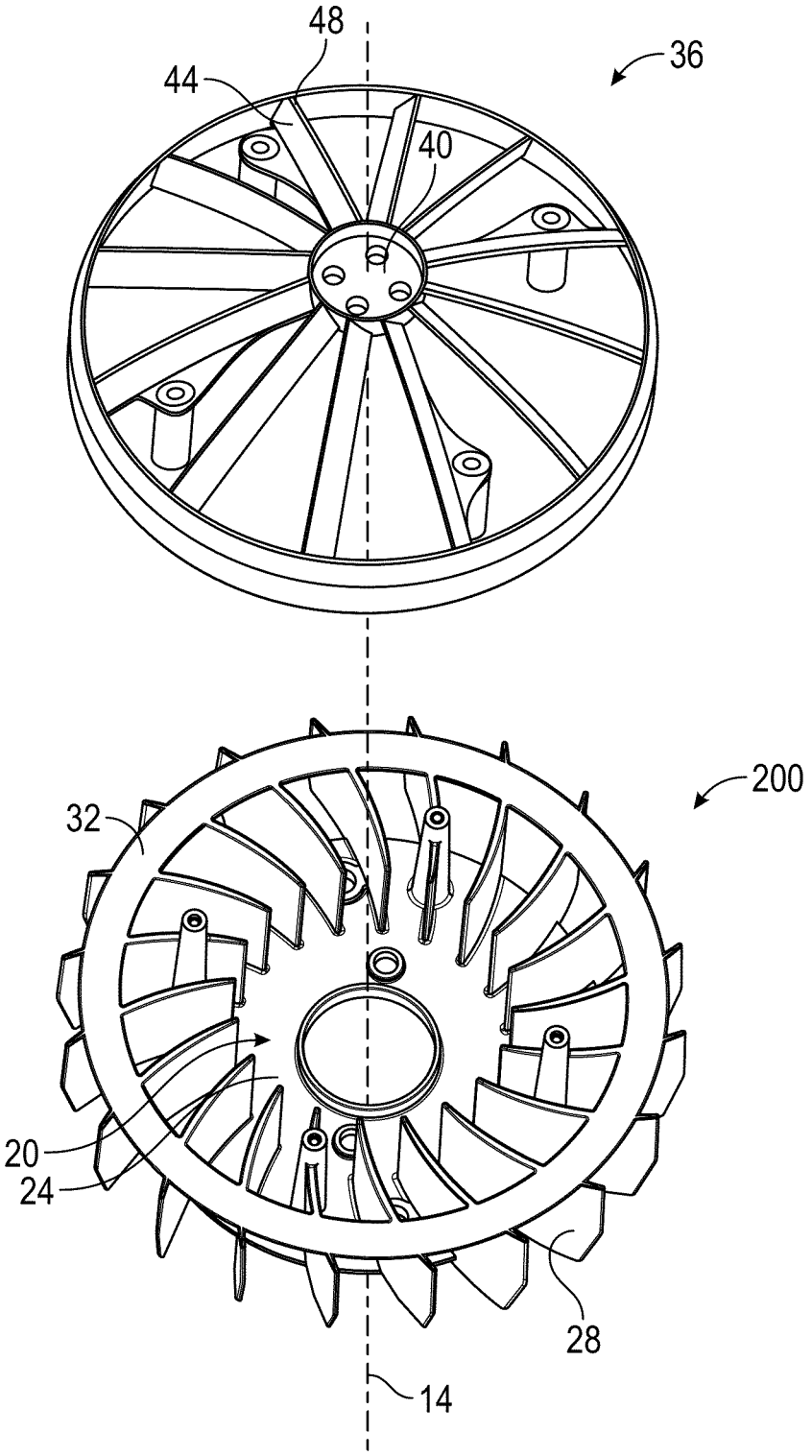
FIG. 4B is an exploded perspective view of the fan assembly of FIG. 4A.
Figure 5:
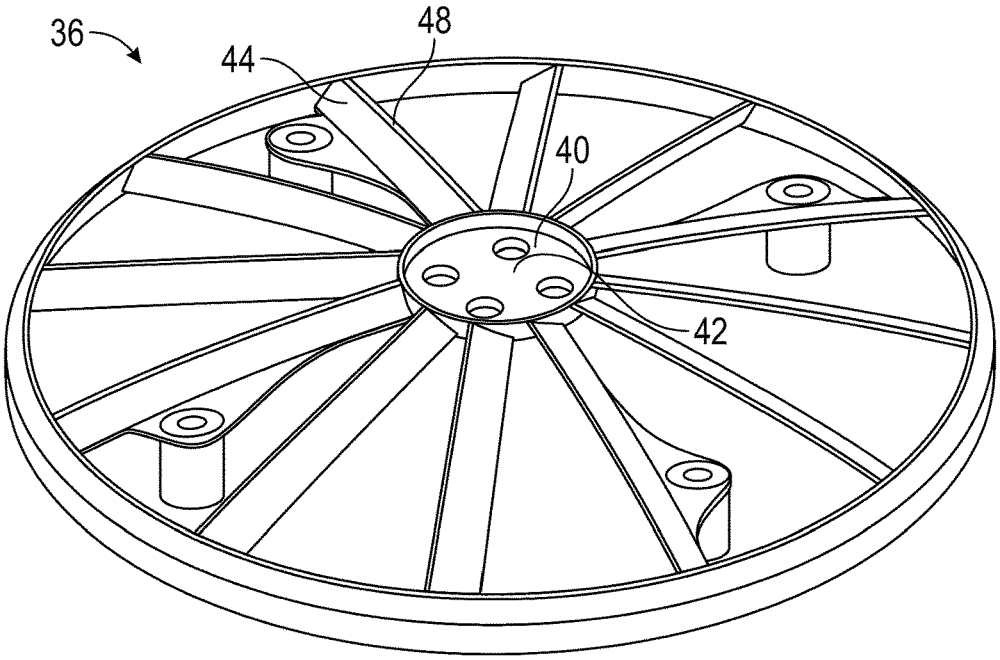
FIG. 5 is a perspective view of the screen of FIG. 4A.

Referring to FIG. 3, the engine assembly 2 includes a pair of pistons 10 that are received in a pair of cylinders 6. The cylinders 6 are in a V-twin configuration. While in FIG. 3, the pistons 10 are shown in a single-pin configuration such that they rotate a crankshaft 11 of the engine assembly 2 in unison, the pistons 10 may be arranged in any pin configuration, such as a double-pin configuration. The crankshaft 11 is configured to rotate in response to actuation of the pair of pistons 10 to provide an output to rotate the shaft 12.

Referring to FIGS. 4A-6E, a fan assembly 200 is shown, including the cooling fan 16 and the screen 36. The cooling fan 16 defines a central axis 14. The cooling fan 16 includes a plate 20 defining an upper surface 24 and a lower surface 22. The cooling fan 16 includes a band 32, and a plurality of reversed fins 28. The screen 36 is coupled to the cooling fan 16, and disposed along the plurality of reversed fins 28. The screen 36 includes a hub 40 positioned orthogonal to the central axis 14 and a plurality of blades 44 extending radially outward from the hub 40. A leading edge 48 is the thinnest cross-sectional portion of each of the plurality of blades 44, according to one embodiment.

Referring to FIGS. 6A-6E and 7A-7C, the band 32 of the cooling fan 16 has an inner band radius 124 and an outer band radius 125. The plurality of reversed fins 28 of the cooling fan 16 are coupled to the band 32 and extend from the upper surface 24 of the plate 20. The band 32 can stabilize the reversed fins 28, increasing airflow through the cooling fan 16. The fins 28 also extend radially outward from the central axis 14 along a plurality of paths that are concave relative to a clockwise direction 15 when viewed from above the cooling fan 16. The plurality of reversed fins 28 extend from a plurality of roots 52 positioned a root radius r from the central axis 14 to a plurality of tips 56 positioned a tip radius t from the central axis 14. The tip radius t is greater than the outer band radius 125 such that the plurality of tips 56 protrude further radially outward from the central axis 14 than the band 32. In some embodiments, the plurality of roots 52 are spaced from the central axis 14 and define a cavity. In some embodiments, the plate 20 and the plurality of reversed fins 28 are integrally formed and define a single unitary body.

Figure 6A:
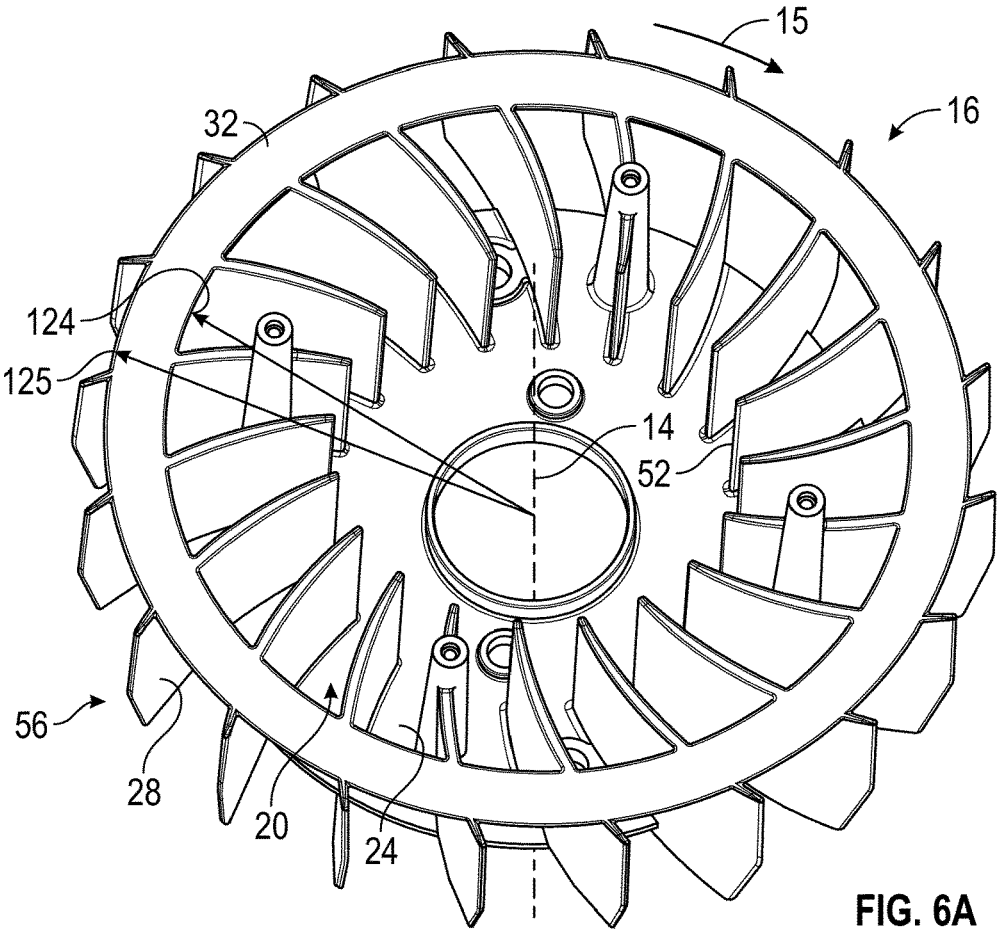
FIG. 6A is a perspective view of the cooling fan of FIG. 4A.
Figure 6B:
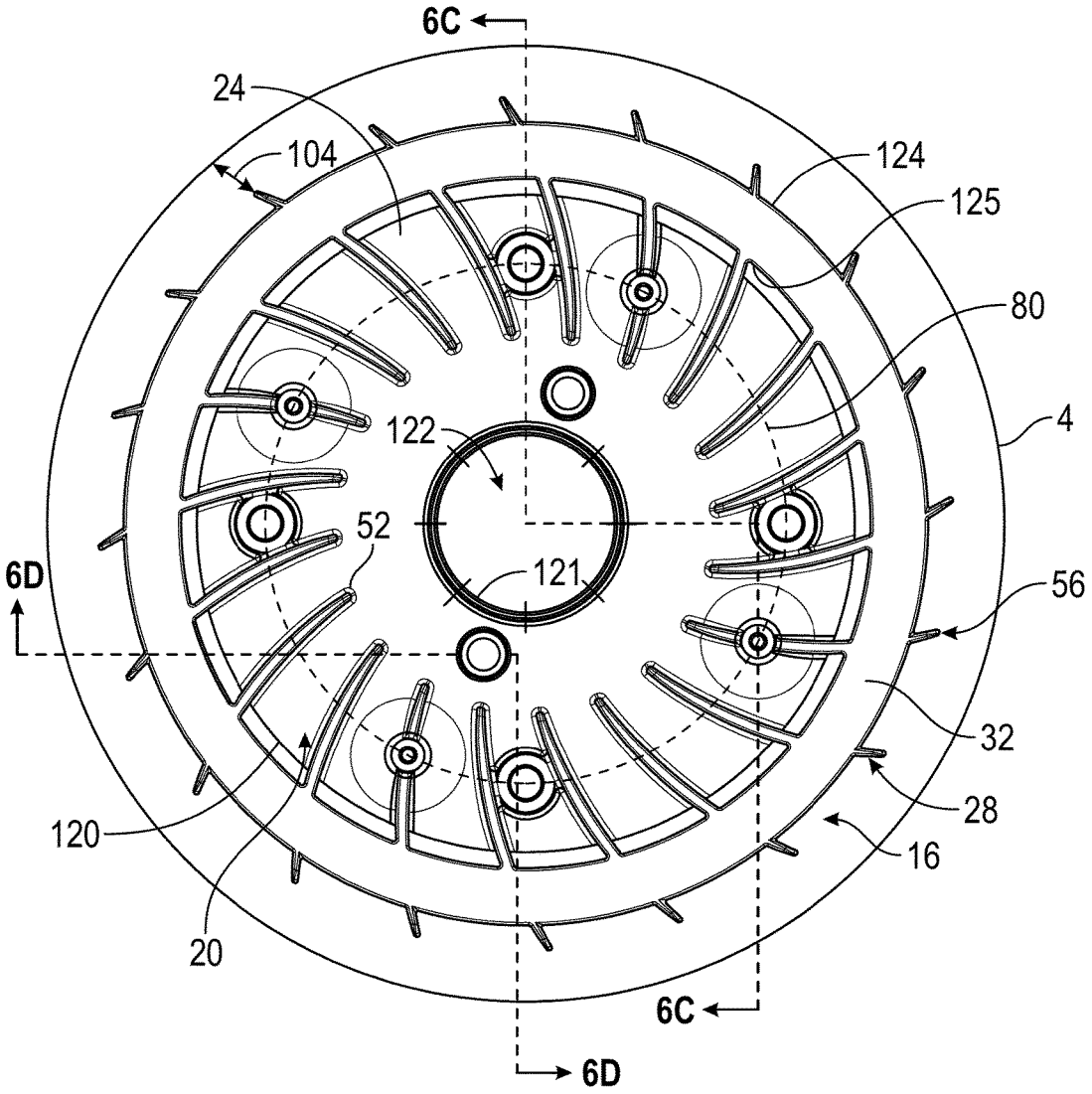
FIG. 6B is a top view of the cooling fan of FIG. 6A.
Figure 6C:
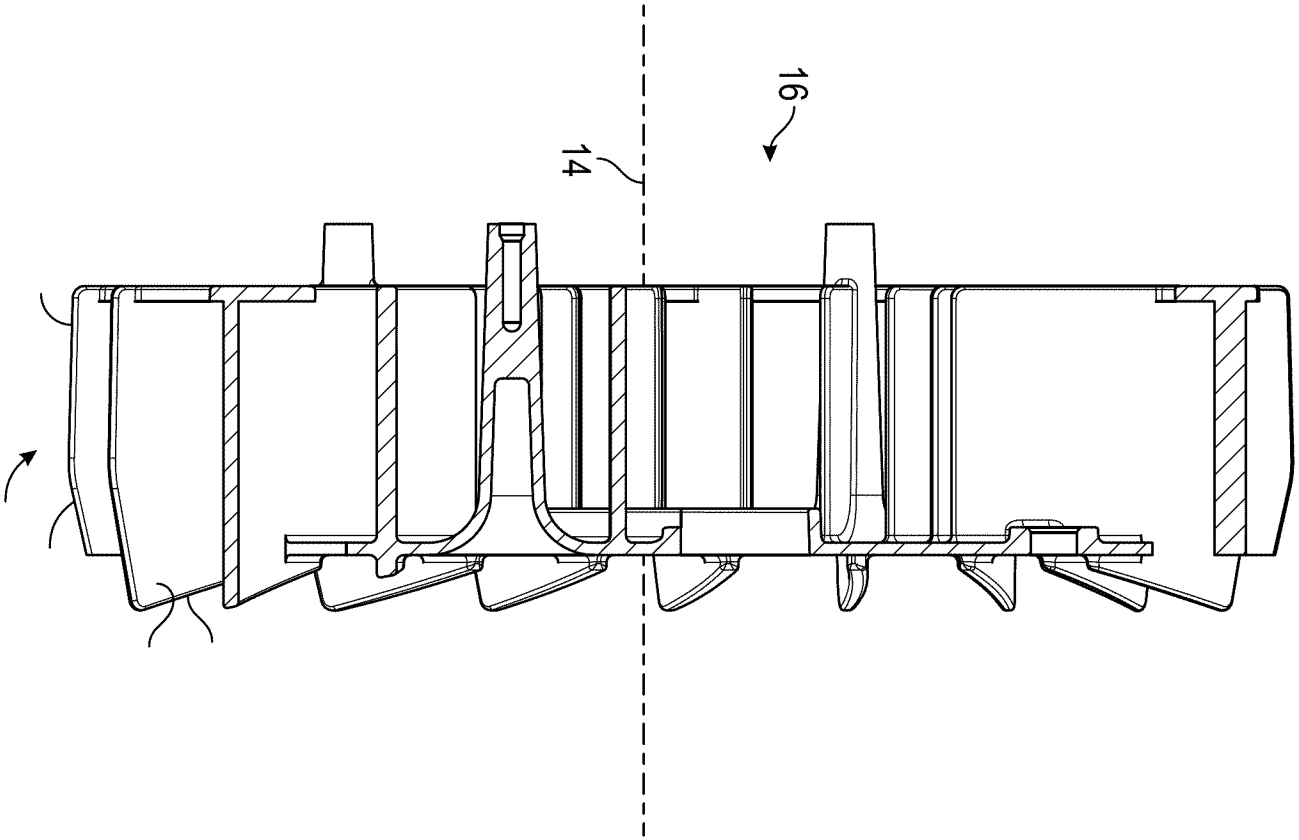
FIG. 6C is a sectional view of the cooling fan of FIG. 6A.
Figure 6D:
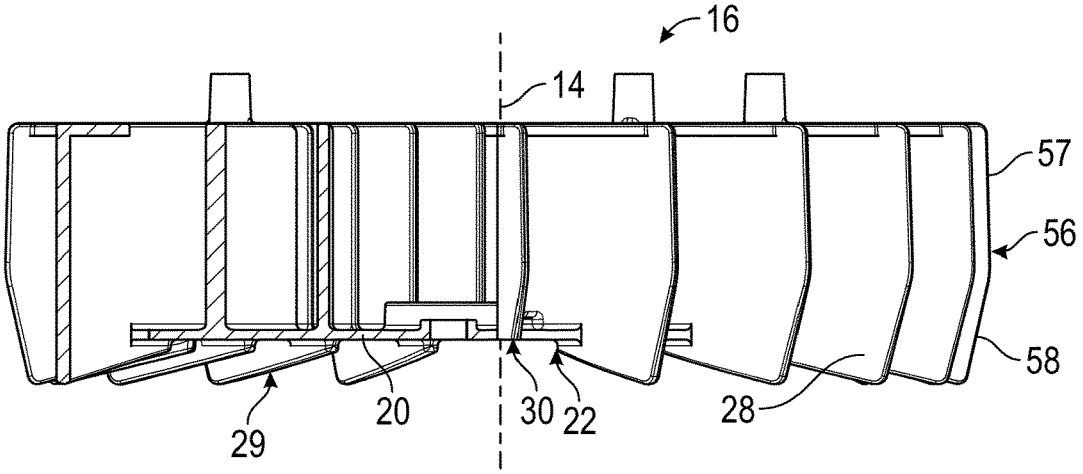
FIG. 6D is a sectional view of the cooling fan of FIG. 6A.
Figure 6E:
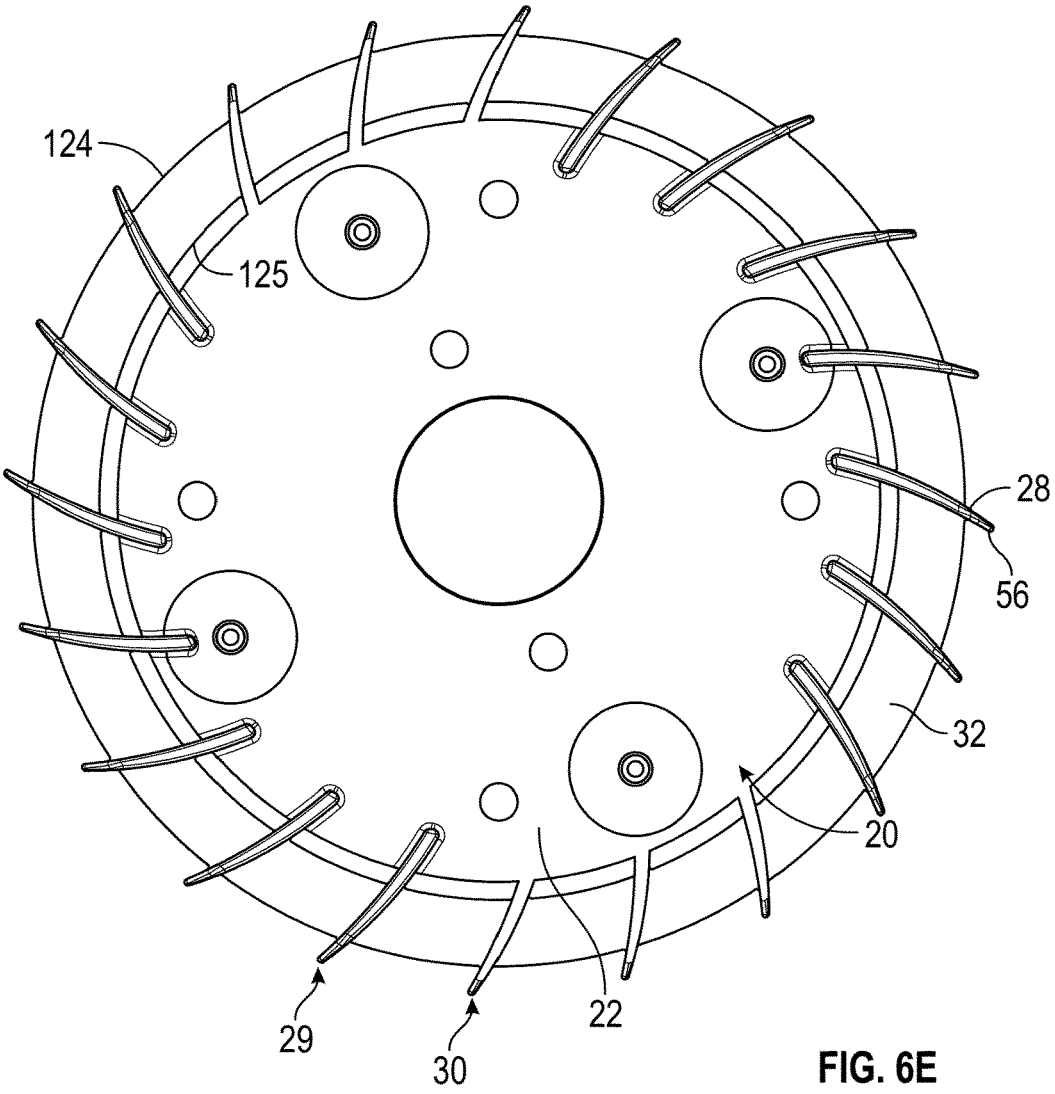
FIG. 6E is a bottom view of the cooling fan of FIG. 6A.
Figure 6F:
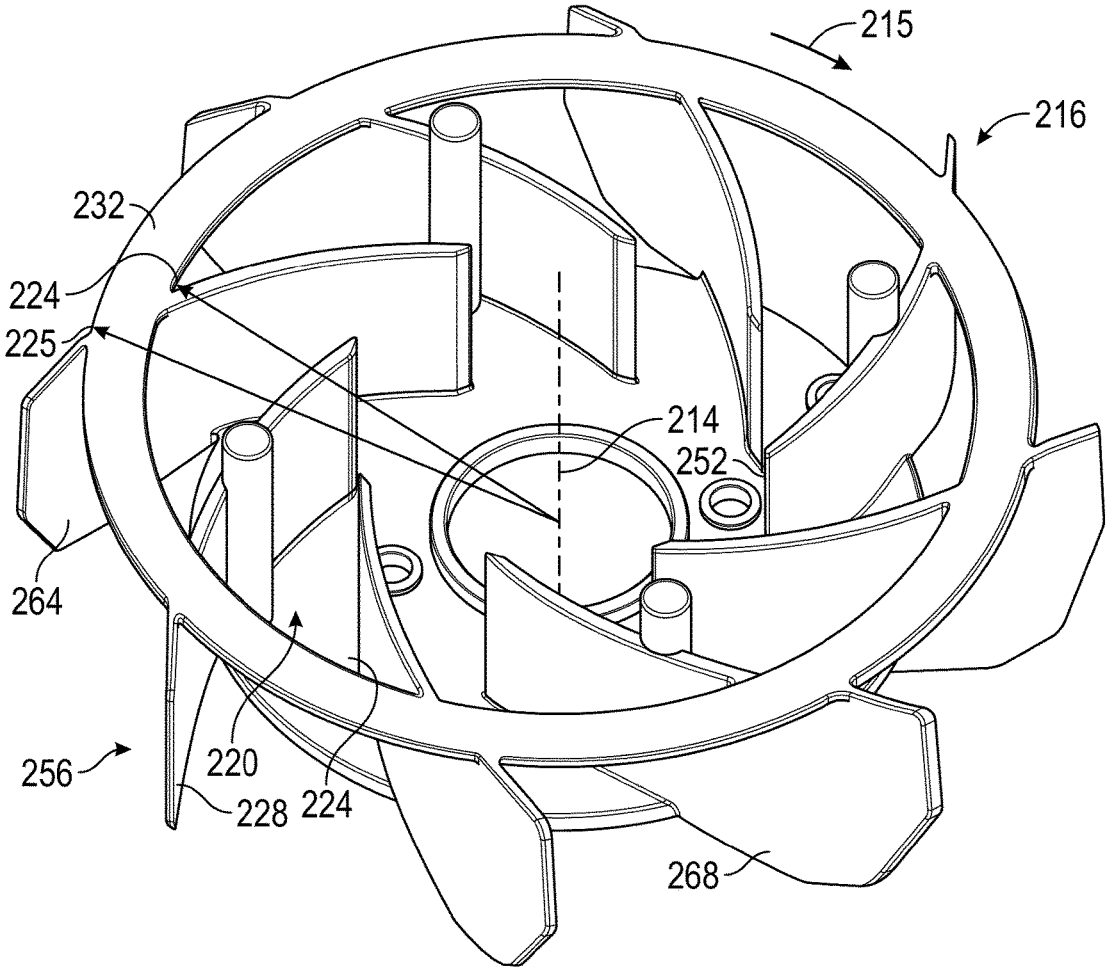
FIG. 6F is a perspective view of a cooling fan, according to one embodiment.
Figure 6G:
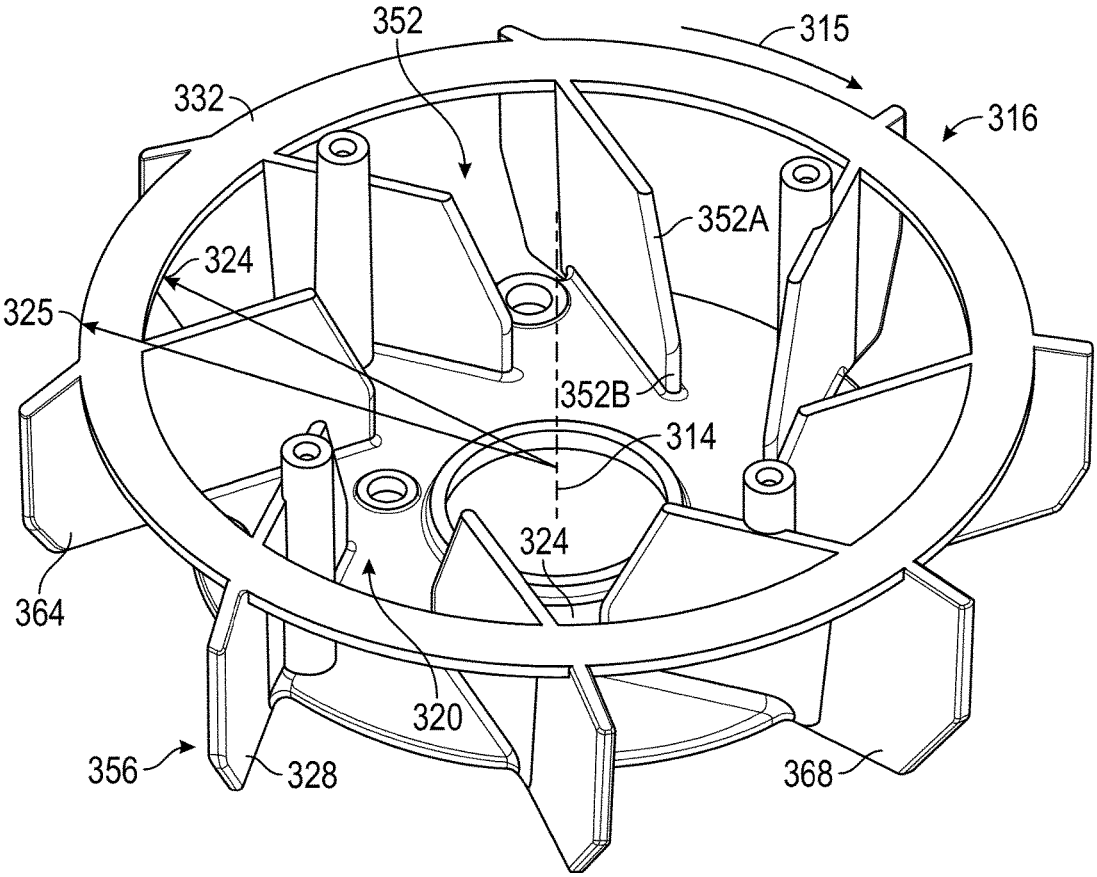
FIG. 6G is a perspective view of a cooling fan having straight reversed fins, according to one embodiment.
Figure 6H:
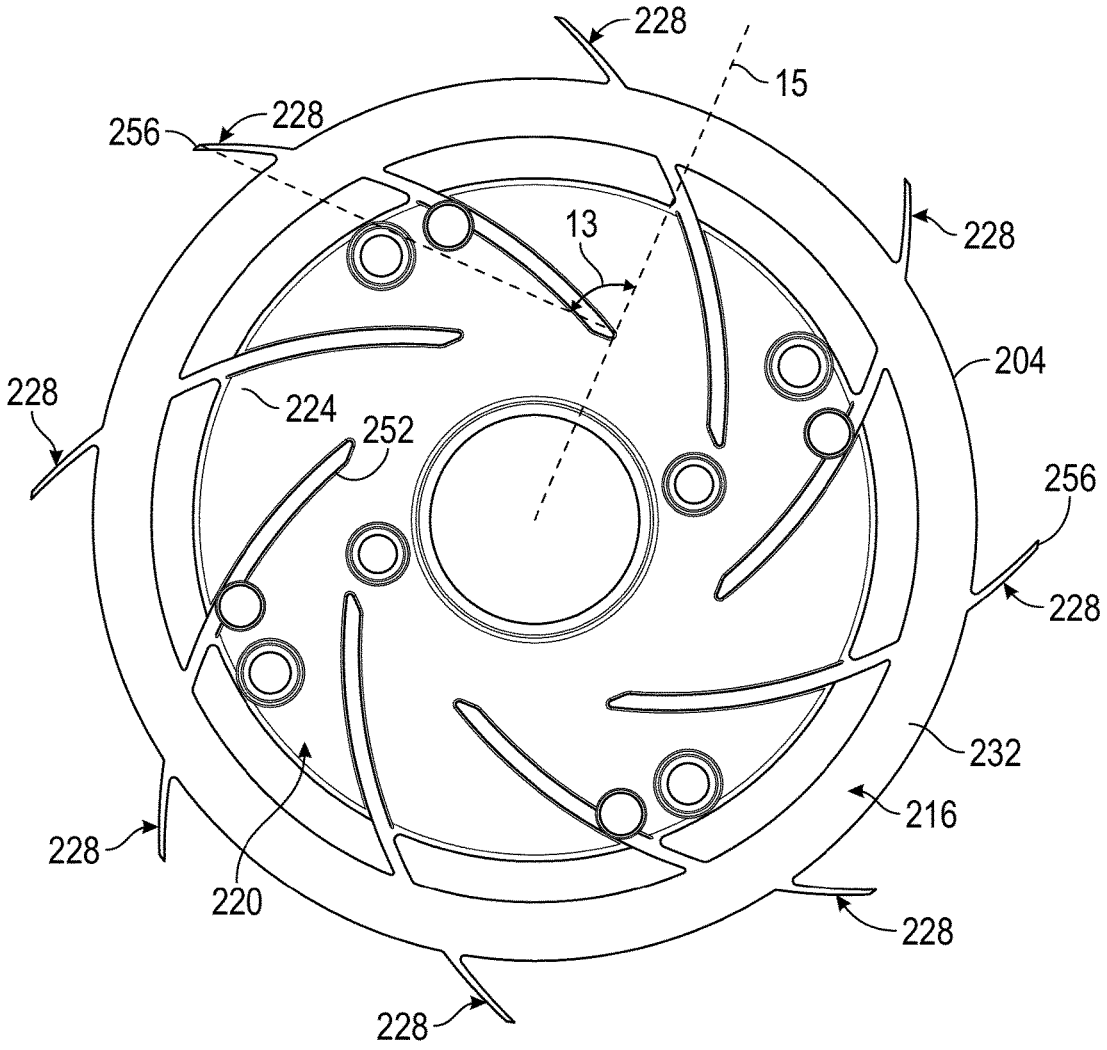
FIG. 6H is a top view of the cooling fan of FIG. 6F.
Figure 6I:
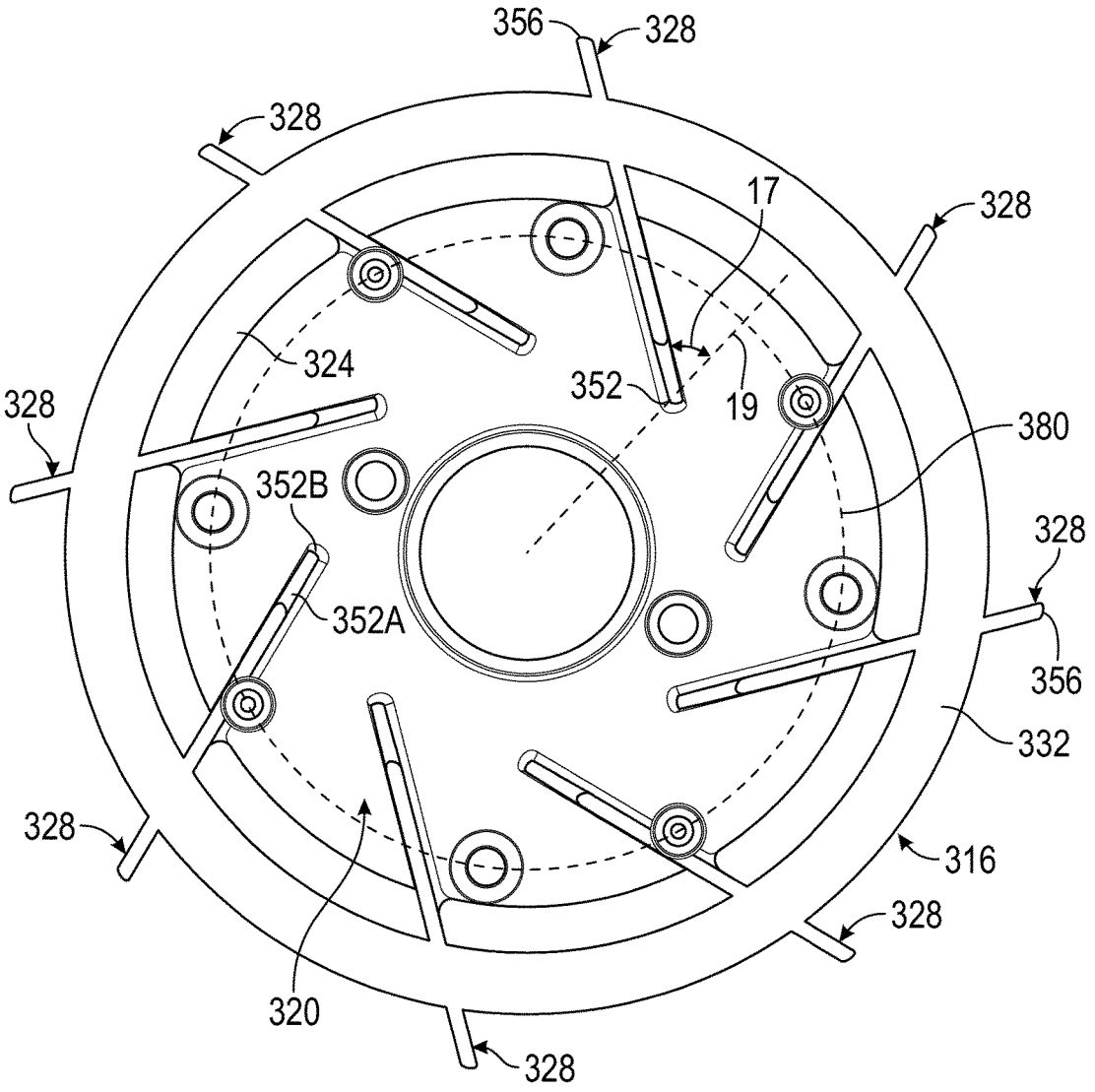
FIG. 6I is a top view of the cooling fan of FIG. 6G.
Figure 7A:
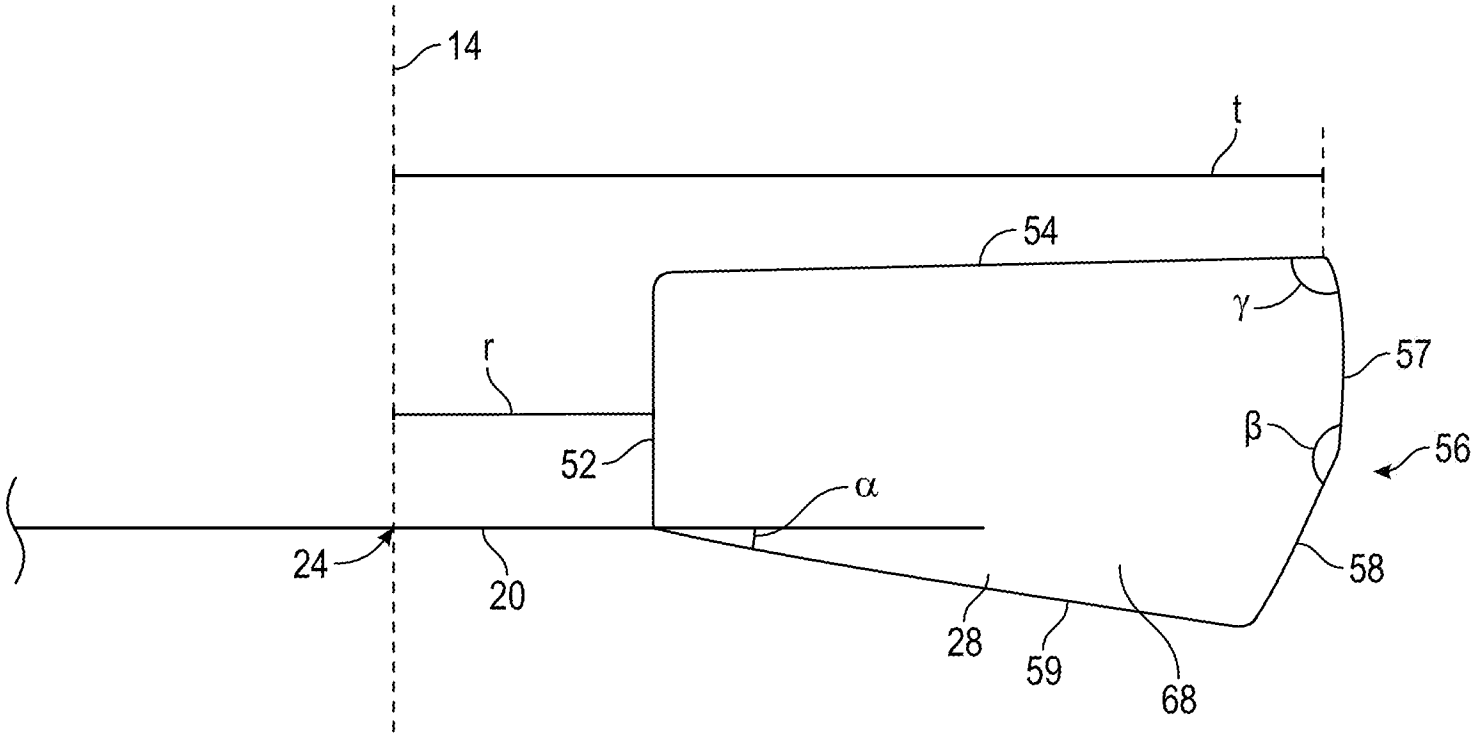
FIG. 7A is a partial detail view of a fin of the cooling fan of FIG. 6A, according to one embodiment.
Figure 7B:
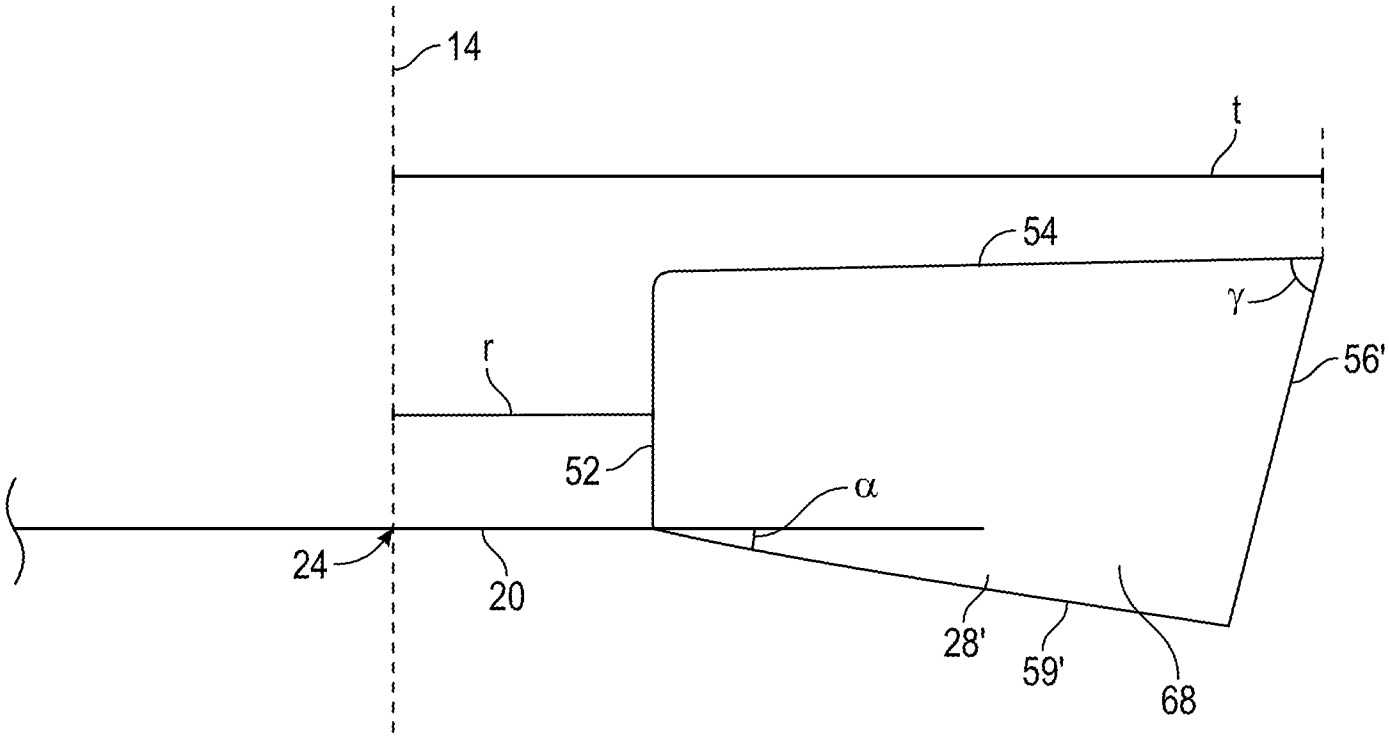
FIG. 7B is a partial detail view of a fin for a cooling fan, according to another embodiment.
Figure 7C:
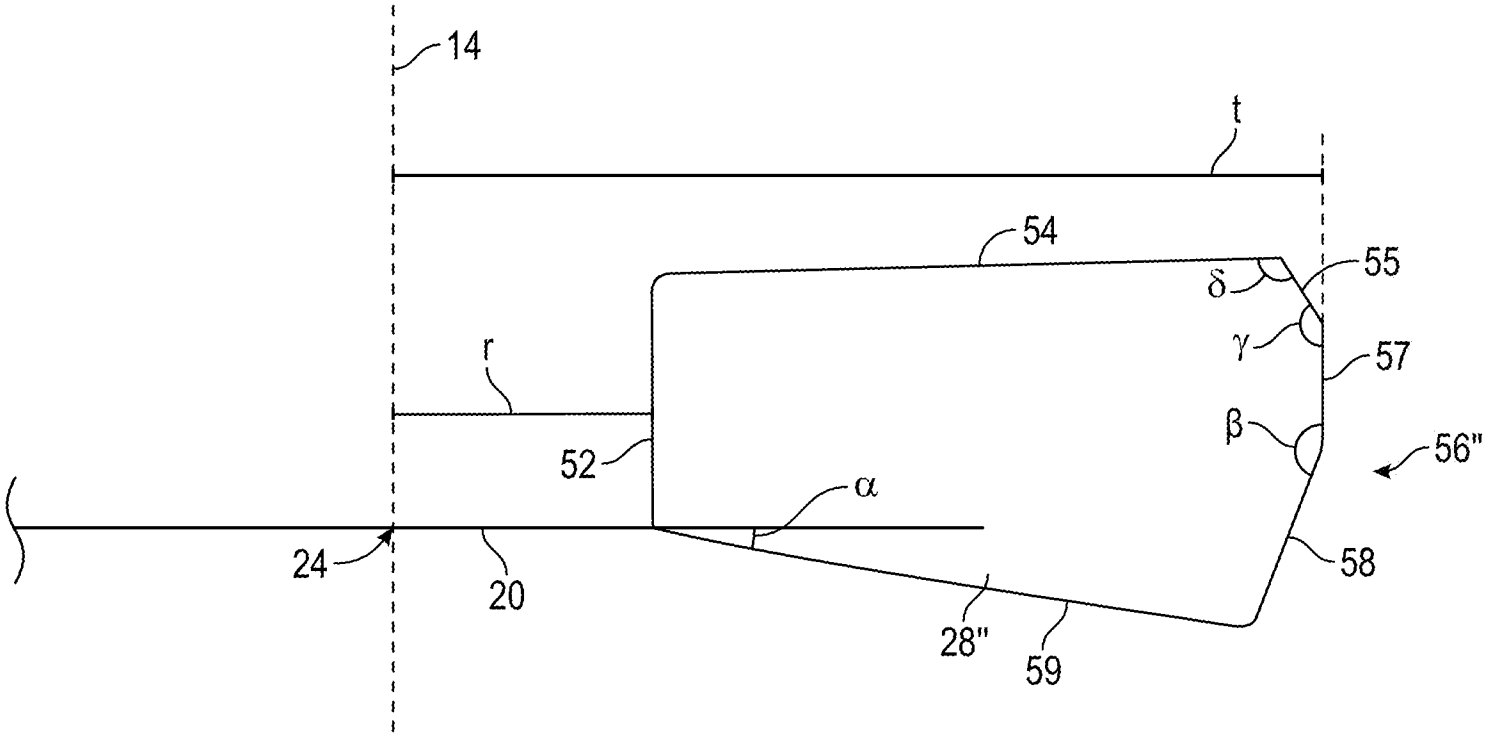
FIG. 7C is a partial detail view of a fin for a cooling fan, according to still another embodiment.
Figure 7D:
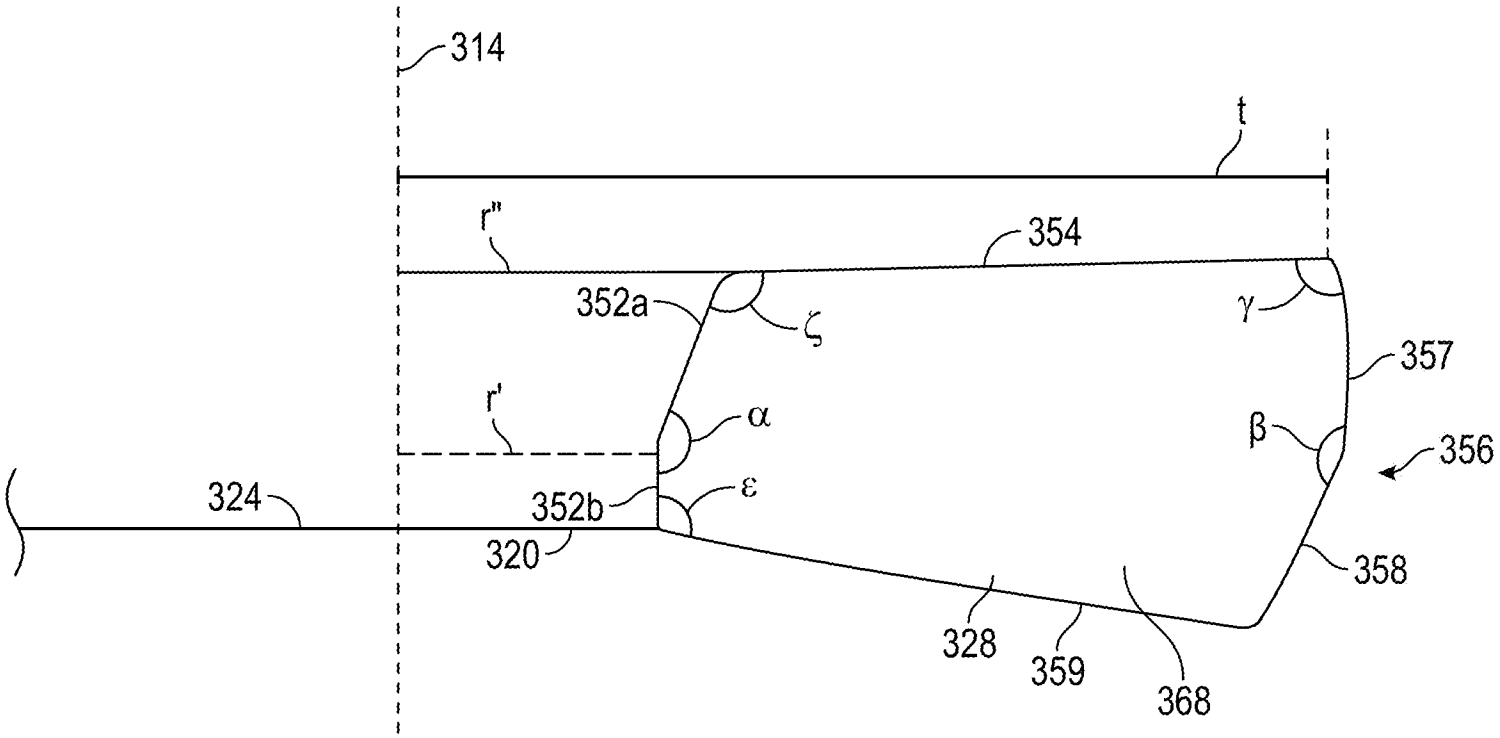
FIG. 7D is a partial detail view of a fin for a cooling fan, according to still another embodiment.

In some embodiments, the cooling fan 16 does not include the band 32 (similarly, in some embodiments, the cooling fan 216 as described with references to FIGS. 6F and 6H does not include the band 232; in some embodiments, the cooling fan 316 as described with references to FIGS. 6G, 6I, and 7D does not include the band 332). For example, as the stability or stiffness of the plurality of reversed fins 28 increases (e.g., by using stiffer material, by using reversed fins that have a curvature), the need to stabilize the reversed fins 28 to maintain airflow may decrease. Similarly, in operational situations where airflow is not as significant of a factor, the cooling fan 16 may not include the band 32 (e.g., to reduce material costs, to facilitate manufacturing the cooling fan 16, to reduce the mass of the cooling fan 16, to alter the distribution of the mass of the cooling fan 16, etc.).

Referring specifically to FIG. 6A, the cooling fan 16 is shown to include twenty fins 28. In other embodiments, the cooling fan 16 includes more or fewer fins. The plurality of fins 28 may have a thickness that is increased or decreased depending on the number of fins 28. For example, the plurality of fins 28 may have a minimum or maximum weight requirement, and the thickness of the fins 28 may be altered to meet such a weight requirement. Alternatively, in some embodiments, the thickness of the fins 28 is held constant, and the number of fins 28 is modified to meet such a weight requirement. In some embodiments, the fins 28 have at least one of the same length, the same curvature, and the same shape.

Referring specifically to FIG. 6B, a top view of the cooling fan 16 is shown, and the plurality of fins 28 of the cooling fan 16 are spaced equally around a periphery of the plate 20. In embodiments where the cooling fan 16 includes twenty fins 28, the fins 28 may be spaced apart by 18 degrees. In other embodiments, the fins 28 are non-uniformly spaced. In some embodiments, at least one of the number and the spacing of the fins 28 decreases the blade pass frequency thereby reducing the noise generated by blade pass.

Referring to FIGS. 6D and 6E, in some embodiments, a first subset 29 of the plurality of reversed fins 28 extends below the lower surface 22 of the plate 20, and a second subset 30 of the plurality of reversed fins 28 extends to a plurality of points that are flush with the lower surface 22 of the plate 20. In other embodiments, the fins 28 all extend below the lower surface 22. In still other embodiments, the reversed fins 28 all extend to a plurality of points that are flush with the lower surface 22.

Referring to FIGS. 6F and 6H, a cooling fan 216 is shown. The cooling fan 216 and any components thereof can be similar to the cooling fan 16. For example, the cooling fan 216 can be used with or included in an engine assembly similar to the engine assembly 2. The cooling fan 216 has fewer fins than the cooling fan 16, which can improve noise reduction relative to the cooling fan 16.

The cooling fan 216 defines a central axis 214 (e.g., an axis about which the cooling fan 216 can be rotated by a shaft 12 of an engine assembly 2, etc.). The cooling fan 216 includes a plate 220. The cooling fan 216 includes a band 232 that is spaced apart from the plate 220 (e.g., spaced apart from an upper surface 224 of the plate 220), the band 232 having an inner band radius 224 and an outer band radius 225. The cooling fan 216 extends between the band 232 and the upper surface 224.

The cooling fan 216 includes a plurality of reversed fins 228. Each reversed fin 228 includes a root 252 adjacent to the central axis 214 (e.g., the root 252 intersects the upper surface 224 of the plate 220 adjacent to the central axis 214) and extends to a tip 256 adjacent to the band 232. For example, as shown in FIG. 6F, the reversed fin 288 extends through the band 232 as the tip 256 extends radially beyond the outer band radius 225 of the band 232. Each reversed fin 228 also extends from the upper surface 224 of the plate 220 (e.g., at least a portion of each reversed fin 228 coincides with the upper surface 224).

Each reversed fin 228 includes a leading surface 264 and a trailing surface 268 opposite the leading surface 264. As shown in FIGS. 6F and 6H, the leading surface 264 and trailing surface 268 have curvilinear profiles (e.g., curved in a plane parallel to the plate 220 and linear in a plane perpendicular to the plate 220). As shown in FIGS. 6F and 6H, the leading surface 264 is the surface of the reversed fin 228 that first contacts fluid around the cooling fan 216 as the cooling fan rotates in a clockwise direction 215; similarly, if a path is traveled in the clockwise direction 215 about the cooling fan 216 while the cooling fan 216 is fixed in space, the trailing surface 268 of each reversed fin 228 will be intersected prior to the leading surface 264.

Each reversed fin 228 is offset at an angle 13 measured from a plane 15 passing through the rotational axis 214 and the tip 256, to a plane passing through the root 252 and the tip 256. In some embodiments, the angle 13 is greater than zero degrees and less than or equal to ninety degrees (e.g., fifteen degrees, thirty degrees, forty-five degrees, sixty degrees, seventy-five degrees, etc.). In some embodiments, the angle 13 can be determined or selected based on factors such as airflow through the cooling fan 216, blade pass frequency, and turbulence about the cooling fan 216. For example, the angle 13 can be modified depending on desired airflow through or noise generated by the cooling fan 216.

As shown in FIGS. 6F and 6H, each reversed fin 228 defines a curvature. For example, each reversed fin 228 curves from the root 252 to the tip 256 such that the reversed fin 228 extends radially outward from the central axis 214 along a path that is concave relative to a clockwise direction 215 when viewed from above the cooling fan 216. For example, as the cooling fan 216 rotates in a clockwise direction about the central axis 214, the leading face 264 of each reversed fin 228 can first come into contact (e.g., direct contact) with fluid (e.g., air) adjacent to the reversed fin 228, while the trailing face 268 of the reversed fin 228 trails the leading face 264. The leading face 264 is convex when viewed in a direction perpendicular to the leading face 264 (e.g., in a direction opposite the clockwise direction 215). Orienting the plurality of reversed fins 228 in such a reversed manner reduces noise generated by the cooling fan 216 by decreasing blade pass frequency to reduce blade pass noise and/or by reducing turbulence.

In some embodiments, the cooling fan 216 can include between two and sixteen reversed fins 228, including any number within that range (e.g., eight reversed fins 228 as shown in FIGS. 6F and 6H). The number of reversed fins 228 can be selected based on factors such as airflow through the cooling fan 216, blade pass frequency, and turbulence about the cooling fan 216.

Referring to FIGS. 6G and 6I, a cooling fan 316 is shown. The cooling fan 316 and any components thereof can be similar to the cooling fan 16 or the cooling fan 216. For example, the cooling fan 316 can be used with or included in an engine assembly similar to the engine assembly 2. As compared to the cooling fan 16 and the cooling fan 216, the cooling fan 316 includes reversed fins 328 having a straight profile (e.g., the fin 328 extends linearly between a root 352 and a tip 356, with parallel, planar leading surface 364 and trailing surface 368 each extending from the root 352 to the tip 356). By using a straight profile for the reversed fins 328, the cooling fan 316 can be used in applications requiring greater air flow and/or lesser noise reduction features as compared to the cooling fan 16 or the cooling fan 216.

The cooling fan 316 defines a central axis 314. The cooling fan 316 includes a plate 320. The cooling fan 316 includes a band 332 that is spaced apart from the plate 320 (e.g., spaced apart from an upper surface 324 of the plate 320), the band 332 having an inner band radius 324 and an outer band radius 325. The cooling fan 316 extends between the band 332 and the upper surface 324.

The cooling fan 316 includes a plurality of reversed fins 328. Each reversed fin 328 includes a root 352 including a first root portion 352*b* and a second root portion 352*a*, which are described in further detail with regards to FIG. 7D. The root 352 is adjacent to the central axis 314 and extends to a tip 356 adjacent to the band 332. Each reversed fin 328 includes a leading surface 364 and a trailing surface 368 opposite the leading surface 364. The leading surface 364 and trailing surface 368 have planar profiles and are parallel to one another. Each reversed fin 328 follows a straight path from the root 352 to the tip 356 such that the reversed fin 328 extends radially outward from the central axis 214 along a path that is straight relative to a clockwise direction 315 when viewed from above the cooling fan 316. Providing the plurality of reversed fins 228 as straight fins increases a rate of airflow through the cooling fan 316 relative to other cooling fans. In some embodiments, the cooling fan 316 includes eight reversed fins 328.

Each reversed fin 328 is offset at an angle 17 measured in a counterclockwise direction from a plane 19 passing through the rotational axis 314 and the tip 356, to a plane passing through the root 352 and the tip 356. In some embodiments, the angle 17 is greater than zero degrees and less than or equal to ninety degrees (e.g., fifteen degrees, thirty degrees, forty-five degrees, sixty degrees, seventy-five degrees, etc.). In some embodiments, the angle 17 can be determined or selected based on factors such as airflow through the cooling fan 316, blade pass frequency, and turbulence about the cooling fan 316. For example, the angle 17 can be modified depending on desired airflow through or noise generated by the cooling fan 316.

Referring to FIG. 7A, a fin 28 of the cooling fan 16 is shown that includes a first edge 54, a second edge 57, a third edge 58 adjoining the second edge 57, and a fourth edge 59 adjoining the third edge 58. The fin also includes a root 52 positioned a root radius r from the central axis 14, and a tip 56 positioned a tip radius t from the central axis 14. The third edge 58 is angularly offset by an angle β from the second edge 57. In one embodiment, angle β is between 150 degrees and 180 degrees (e.g., 167 degrees, etc.). The fourth edge 59 is angularly offset by an angle α from the plate 20. In one embodiment, angle α is no more than 30 degrees (e.g., 15 degrees, etc.). The first edge 54 is angularly offset by an angle γ from the second edge 57. In some embodiments, the angle γ is 90 degrees. At least one of the angles α, β, and γ are specified to reduce noise (e.g., by reducing turbulence caused by rotation of the cooling fan, by reducing blade pass frequency, etc.).

Referring to FIG. 7B, a fin 28' is shown that includes an edge 54, a tip 56', and an edge 59'. The fin includes a root 52 positioned a root radius r from the central axis 14, and the tip 56' is positioned a tip radius t from the central axis 14. The edge 59' is angularly offset by an angle α from the plate 20. In one embodiment, angle α is no more than 30 degrees (e.g., 15 degrees, etc.). The edge 54 is angularly offset by an angle γ from the tip 56'. In one embodiment, angle γ is no more than 90 degrees (e.g., 45 degrees, 60 degrees, etc.). At least one of the angles α and γ are specified to reduce noise (e.g., by reducing turbulence caused by rotation of the cooling fan, by reducing the blade pass frequency, etc.). In one embodiment, the tip 56' forms an edge have various portions that are spaced different distances from a housing 4 within which the cooling fan 16 is disposed. By way of example, the housing 4 may have a vertical sidewall, and the angle γ may be specified such that the spacing between the tip 56' and the housing 4 varies according to a target profile along a height of the fin 28'. As shown in FIG. 7B, the spacing between the tip 56' and the housing 4 varies linearly along the height of the fin 28'. Such variation in the spacing between the tip 56' and the housing 4 may further reduce noise by decreasing the blade pass frequency and the turbulence associated with rotation of the cooling fan 16.

Referring to FIG. 7C, a fin 28" is shown that includes a first edge 54, a second edge 55, a third edge 57, a fourth edge 58, and a fifth edge 59. The fin also includes a root 52 positioned a root radius r from the central axis 14, and a tip 56" positioned a tip radius t from the central axis 14. The fifth edge 59 is angularly offset by an angle α from the plate 20. In one embodiment, angle α is no more than 30 degrees (e.g., 15 degrees, etc.). The second edge 55 is angularly offset by an angle β from the third edge 57. In one embodiment, angle β is between 150 degrees and 180 degrees (e.g., 167 degrees, etc.). The first edge 54 is angularly offset by an angle δ from the second edge 55. In one embodiment, angle δ is greater than 90 degrees and less than 180 degrees (e.g., 120 degrees, 150 degrees, etc.). At least one of the angles α, β, γ, and δ are specified to reduce noise (e.g., by reducing turbulence caused by rotation of the cooling fan, by reducing the blade pass frequency, etc.).

Referring to FIG. 7D and further to FIGS. 6G and 6I, the reversed fin 328 is shown in further detail. The reversed fin 328 can be similar to the fins illustrated in FIGS. 7A-7C. Features of the fin 328 can be used for other cooling fans described herein (e.g., for fins of cooling fan 16, cooling fan 216, etc.). The reversed fin 328 includes a first edge 354, the tip 336 including a second edge 357 adjoining the first edge 354 and a third edge 358 adjoining the second edge 357, a fourth edge 359 adjoining the third edge 358 (e.g., adjoining the tip 356), and the root 352 adjoining the first edge 354 and the fourth edge 359. The root 352 includes a second root portion 352*a* adjoining the first edge 359 and a first root portion 352*b* adjoining the second root portion 352*a* and the fourth edge 359. The first root portion 352*b* can be perpendicular to the plate 320. The first root portion 352*b* is spaced from the central axis 314 by a first radius r', oriented at an angle α relative to the second root portion 352*a*, and oriented at an angle c relative to the fourth edge 359. The second root portion 352*a* is spaced from the central axis 314 by a second radius r" as measured to the intersection of the second root portion 352*a* and the first edge 354. The angle α can be obtuse as measured on a face of the reversed fin 328. For example, the angle α can be greater than 90 degrees and less than 180 degrees (e.g., 105 degrees, 120 degrees, 135 degrees, 150 degrees, 175 degrees, etc.). The angle ε can be obtuse as measured on a face of the reversed fin 328. For example, the angle ε can be greater than 90 degrees and less than 180 degrees (e.g., 105 degrees, 120 degrees, 135 degrees, 150 degrees, 175 degrees, etc.). The second root portion 352*a* can define an angle ζ relative to the first edge 354. The angle ζ can be obtuse as measured on a face of the reversed fin 328. For example, the angle ζ can be greater than 90 degrees and less than 180 degrees (e.g., 105 degrees, 120 degrees, 135 degrees, 150 degrees, 175 degrees, etc.). In some embodiments, orienting the first root portion 352*b* perpendicular to the plate 320, and the second root portion 352*a* at an angle α relative to the first root portion 352*b*, can reduce stress on the reversed fins 328 of the cooling fan 316, increasing longevity of the cooling fan 316 while mitigating the need to repair or replace the cooling fan 316.

The construction and arrangement of the apparatus, systems, and methods as shown in the various exemplary embodiments are illustrative only. Although only a few embodiments have been described in detail in this disclosure, many modifications are possible (e.g., variations in size, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

What is claimed is:

1. An engine assembly, comprising:

a crankcase;

a shaft rotatably coupled to the crankcase and defining a rotational axis;

a blower housing including an internal space; and a cooling fan disposed within the internal space and coupled to the shaft, wherein the cooling fan is positioned to rotate with the shaft about the rotational axis, the cooling fan comprising:

a plate defining an upper surface and a lower surface;

a band having an inner band radius and an outer band radius; and a plurality of reversed fins extending between the band and the upper surface of the plate, the plurality of reversed fins extending between a root adjacent to the rotational axis and a tip adjacent to the outer band radius, each of the reversed fins offset at an angle measured in a counterclockwise direction from a plane passing through the rotational axis and the tip to a plane passing through the root and the tip when viewed from above the cooling fan;

wherein a space between the blower housing and the tip varies linearly along a height of each of the plurality of reversed fins.

2. The engine assembly of claim 1, wherein each angle an offset of the reversed fins is greater than zero degrees and less than or equal to ninety degrees.

3. The engine assembly of claim 1, wherein the plurality of reversed fins extend radially outward from the rotational axis along a plurality of paths that are concave relative to a clockwise direction when viewed from above the cooling fan.

4. The engine assembly of claim 1, wherein each reversed fin includes a leading surface extending between the root and the tip and a trailing surface extending between the root and the tip, the leading surface and the trailing surface each being planar and parallel to one another.

5. The engine assembly of claim 1, wherein the plurality of reversed fins numbers between six and ten fins.

6. The engine assembly of claim 1, further comprising a screen coupled to the cooling fan and disposed above the plurality of reversed fins, the screen including a hub positioned orthogonal to the rotational axis and a plurality of blades extending radially outward from the hub.

7. The engine assembly of claim 6, wherein the cooling fan and the screen are integrally formed and define a single unitary body.

8. The engine assembly of claim 1, further comprising a pair of pistons, a pair of cylinders in a V-twin configuration that receive the pair of pistons, and a crankshaft coupled to the pair of pistons and the shaft, wherein the crankshaft is configured to rotate in response to actuation of the pair of pistons to provide an output to rotate the shaft.

9. A fan assembly, comprising:

a cooling fan defining a central axis, the cooling fan including:

a plate defining an upper surface and a lower surface;

a band having an inner band radius and an outer band radius; and a plurality of reversed fins extending between the band and the upper surface of the plate, the plurality of reversed fins extending between a root adjacent to the rotational axis and a tip adjacent to the outer band radius, each of the reversed fins offset at an angle measured in a counterclockwise direction from a plane passing through the rotational axis and the tip to a plane passing through the root and the tip when viewed from above the cooling fan; and a screen coupled to the cooling fan and disposed along the plurality of reversed fins, the screen including:

a hub positioned orthogonal to the central axis; and a plurality of blades extending radially outward from the hub, wherein a leading edge of each blade is the thinnest cross-sectional portion of each of the plurality of blades.

10. The fan assembly of claim 9, wherein each angle is greater than zero degrees and less than or equal to ninety degrees.

11. The fan assembly of claim 9, wherein the plurality of reversed fins extend radially outward from the rotational axis along a plurality of paths that are concave relative to a clockwise direction when viewed from above the cooling fan.

12. The fan assembly of claim 9, wherein the plurality of reversed fins numbers between six and ten fins.

13. The fan assembly of claim 9, wherein the cooling fan and the screen are integrally formed and define a single unitary body.

14. A cooling fan, comprising:

a plate having an upper surface and a lower surface and defining a central axis; and a plurality of reversed fins extending from the upper surface of the plate, the plurality of reversed fins extending between a root adjacent to the rotational axis and a tip opposite the root, each of the reversed fins offset at an angle measured in a counterclockwise direction from a plane passing through the rotational axis and the tip to a plane passing through the root and the tip when viewed from above the cooling fan;

wherein the root includes a first root portion intersecting the plate at a perpendicular angle and a second root portion adjoining the first root portion at an obtuse angle measured on a surface of the reversed fin.

15. The cooling fan of claim 14, wherein each angle of an offset of the reversed fins is greater than zero degrees and less than or equal to ninety degrees.

16. The cooling fan of claim 14, wherein the plurality of reversed fins extend radially outward from the rotational axis along a plurality of paths that are concave relative to a clockwise direction when viewed from above the cooling fan.

17. The cooling fan of claim 14, wherein each reversed fin includes a leading surface extending between the root and the tip and a trailing surface extending between the root and the tip, the leading surface and the trailing surface each being planar and parallel to one another.

18. The cooling fan of claim 14, wherein the plate and the plurality of reversed fins are integrally formed and define a single unitary body.

19. The cooling fan of claim 14, wherein the plurality of reversed fins numbers between six and ten fins.

* * * * *